US005951103A

United States Patent [19]

Barnhill

[11] Patent Number: 5,951,103

[45] Date of Patent: Sep. 14, 1999

[54] FOLDABLE COMBINATION CHAIRS AND TABLE

[75] Inventor: Claude Barnhill, South Bend, Ind.

[73] Assignee: C & B Inventions L.L.C., South Bend, Ind.

[21] Appl. No.: 09/061,167

[22] Filed: Apr. 16, 1998

[51] Int. Cl.[6] ..... A47C 15/00

[52] U.S. Cl. ..... 297/248; 297/31; 297/183.5; 297/184.15; 297/188.01; 297/440.1

[58] Field of Search ..... 297/232, 248, 297/184.1, 184.11, 184.15, 257, 188.2, 188.21, 188.01, 378.1, 452.2, 440.24, 440.1, 31, 183.1, 183.5, 16.1, 17, DIG. 6

[56] References Cited

U.S. PATENT DOCUMENTS

| | | | |
|---|---|---|---|
| 1,858,254 | 5/1932 | Uline . | |
| 3,494,662 | 2/1970 | Schaefer et al. . | |
| 3,635,521 | 1/1972 | Shivvers . | |
| 4,103,965 | 8/1978 | Engman | 297/192 |
| 4,687,248 | 8/1987 | Ross et al. | 297/129 |
| 4,687,249 | 8/1987 | Mills | 297/184 |
| 4,736,825 | 4/1988 | Belfi | 190/8 |
| 4,834,415 | 5/1989 | Yee | 280/644 |
| 4,886,229 | 12/1989 | Aripze-Gilmore | 248/125 |
| 5,080,432 | 1/1992 | Connell | 297/184 |
| 5,251,956 | 10/1993 | Hofmeyer | 297/173 |
| 5,289,958 | 3/1994 | Jay . | |
| 5,301,998 | 4/1994 | Davis | 297/135 |
| 5,340,190 | 8/1994 | Engel | 296/180.1 |
| 5,340,193 | 8/1994 | Wolf . | |
| 5,498,054 | 3/1996 | Tomlinson . | |
| 5,529,375 | 6/1996 | English . | |
| 5,542,159 | 8/1996 | Schultz et al. . | |
| 5,570,928 | 11/1996 | Staunton et al. | 297/232 |
| 5,582,458 | 12/1996 | Wildt . | |

FOREIGN PATENT DOCUMENTS

| | | |
|---|---|---|
| 443924 | 2/1950 | Italy . |

*Primary Examiner*—Milton Nelson, Jr.
*Attorney, Agent, or Firm*—Oblon, Spivak, McClelland, Maier & Neustadt, P.C.

[57] ABSTRACT

A portable collapsible chair structure includes two chaise lounges with a table structure held therebetween. Each chaise lounge has a collapsible canopy, and can be folded up into a compact package. Each of the chaise lounges includes two clamping structures. One clamping structure connects each chaise lounge to opposite sides of the table structure and the outside clamping structure on each chaise lounge is arranged to be connected to that on the other chaise lounge. For a folding operation, each chaise lounge is folded into a compact package, then each is folded over the table and held by the outer clamping structures. This folding function is facilitated by the nature of the clamping structures which include variable extensions.

13 Claims, 3 Drawing Sheets

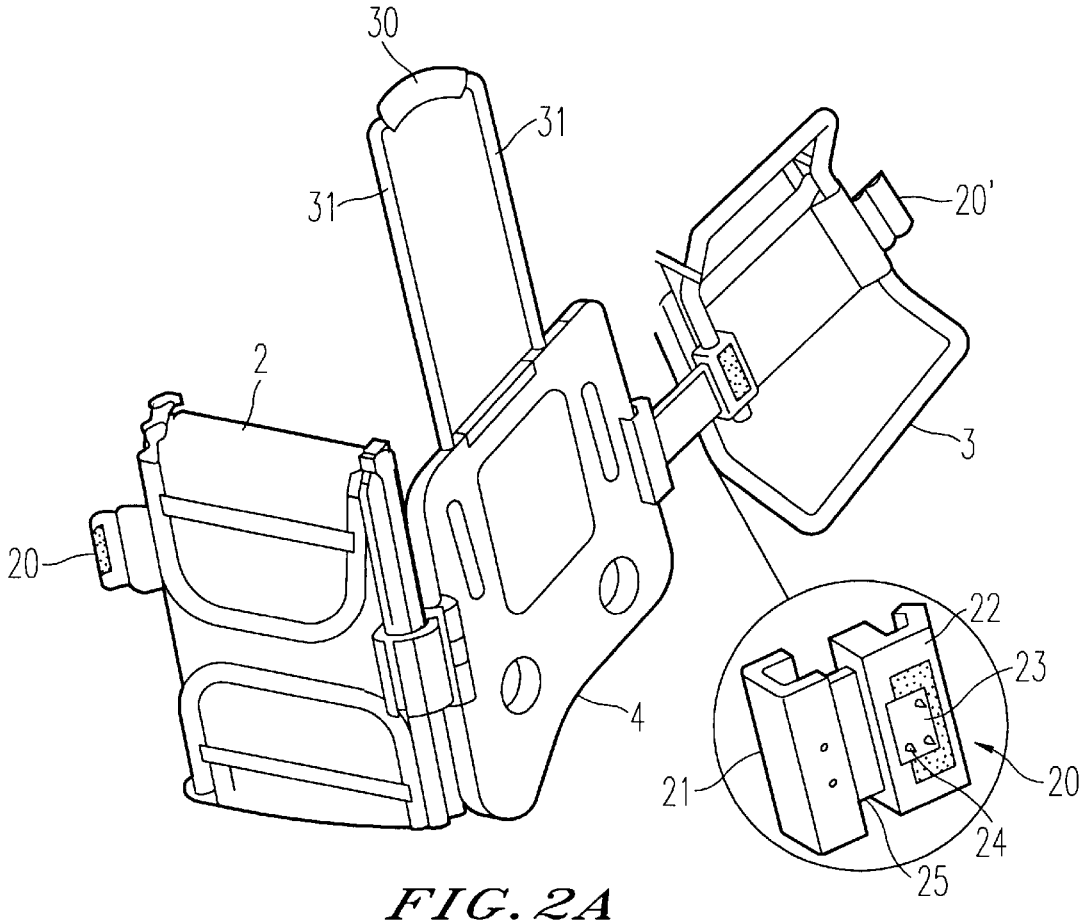
FIG. 2A
FIG. 2B
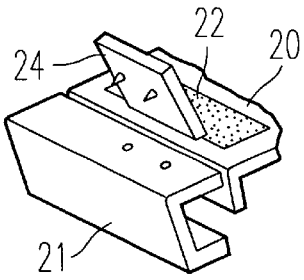
FIG. 2C

FOLDABLE COMBINATION CHAIRS AND TABLE

FIELD OF THE PRESENT INVENTION

The present invention relates to foldable chairs and seats such as that used for beach furniture. More particularly, the present invention relates to a collapsible combination of chairs and a table that can be folded into a single piece for easy transport and carrying.

BACKGROUND ART

Since ancient times there has been a need for portable, simple seating devices that could be easily set up in a variety of different environments, and then easily removed. Thus, the objects of many innovations have been seats that could be folded into a compact size and shape for portability, while being sufficiently strong for rugged service in the field.

One problem with the individual folding chairs known in conventional art is that it is awkward to carry a plurality of them, and they still occupy a relatively large space, even when unfolded. This problem has been addressed in the past to a certain extent by the use of stackable chairs. However, the design characteristics enabling stacking significantly limit other aspects of the chairs such as aesthetic features. Further, stacking chairs take up a considerable amount of storage and/or transportation space even when stacked.

The conventional art includes collapsible chairs that have seat members pivotally connected to seat backs which fold for storage. Collapsible chairs have also been made of light weight materials for easy transportation. However, in spite of these expedients, it is often very awkward for one person to carry two or more collapsible chairs at the same time.

Many other variations of foldable seats and other portable furniture have been developed as part of the conventional art. Such devices are used for such diverse activities as camping, fishing, hunting, and hiking. The use of camp chairs is well known on military campaigns, and has been adopted by spectators at sporting events. The requirements of such furniture include a compact folded size and shape; reasonably light weight for portability; a reasonably attractive appearance; and, comfort for the user.

In the conventional art, the simplest form of foldable seat is the familiar camp stool having a frame and support members formed in an inverted U-shape. Two such U-shaped structures can be pivotally connected at approximately the middle of the respective vertical sides, allowing the two structures to open into an X-shape with an attached flexible seat stretching across the top of the X. When folded, the two U-shaped parts close together against each other in a manner similar to scissors closing, and the flexible seat is folded in between the folding frame parts. A number of foldable seats using the X-shaped arrangement are well known in the conventional art. Some examples are U.S. Pat. No. 4,103,965 to Engman; U.S. Pat. No. 4,886,229 to Aripze-Gilmore; U.S. Pat. No. 4,687,248 to Ross et al.; U.S. Pat. No. 4,736,825 to Belft; and, U.S. Pat. No. 4,834,415 to Yee. All of these are incorporated herein by reference. However, there are certain limitations to the X-shaped structure, including limitations on the weight that the structure will accept, the number of occupants, the ease of handling, and the lack of structure to support accouterments such as canopies, tables, etc.

Some of these limitations have been addressed by U.S. Pat. No. 5,340,190 to Wolf. This patent discloses a foldable portable chair with two side-by-side seats. The supporting framework of the chair includes four support members. The first and second support members are hingeably attached to each other at their upper ends to form an inverted V-shape. The third and fourth support members are also hingeably attached to each other at their lower ends to form a V-shape. The first and third support members and the second and fourth support members are then pivotally attached to each other so as to fold in a scissors-like fashion. A first seat extends between the first support member and the third support member. A second seat extends between the second support member and the fourth support member. In the preferred embodiment of this design, the support members are U-shaped, and arranged so that a storage compartment is suspended between the two seat members.

Unfortunately, the Wolf patent provides no back support. This deficiency has been addressed by the foldable settee in U.S. Pat. No. 1,858,254 to Uline. Back support is provided by detachable members which extend perpendicular to the seat structures. While this dual chair arrangement folds into a compact structure for transport, more than one piece must be carried. Also, assembly and disassembly can be complicated, as are the structures necessary to constitute the back and arm supports for the chairs. Further, this structure has no capacity for accommodating features such as tables or shade canopies.

U.S. Pat. No. 5,570,928 to Staunton et al. discloses joined concertina chairs that can provide for up to 6 chair multiple arrangements. Such arrangements comprise three or more rigid vertical support frames defining the sides of two or more chairs and having front and rear edges, two pairs of diagonally crossed members located, respectively, between the front and rear edge regions of each frame. Each one of the pairs of members are pivotally connected adjacent a lower end to a separate one of an adjacent frame and are pivotally joined to the other member at or near it's midpoint. The upper ends of the two pairs of members define a plane for a seat when the chair arrangement is in a fully deployed seating configuration. A brace is pivotally connected adjacent to the upper ends of each member and pivotally connected to the adjacent support frame. This arrangement includes hand grips associated with the upper end of one or more of each of the pair of members located at the rear of the chairs to enable the chairs to be folded so that the frames are brought together into close proximity when the hand grips are grasped and raised. However, these chairs are formed closely adjacent to each other and provide little additional arm or shoulder space for the adjacent users. Further, there is no provision to accommodate other features such as tables or canopies for the comfort for the users.

Another portable dual-chair arrangement is disclosed in U.S. Pat. No. 5,529,375 to English, and is specifically directed to a beach chair loveseat. The adjoining beach chairs are light and collapsible and arranged in the configuration of a loveseat, allowing two or more persons to sit together with no separating arm rests or other division between them. Each chair is individually collapsible and foldably hinged in a side-by-side configuration to at least one adjoining beach chair so that the beach chair loveseat may fold into a compact fully, collapsed position for portability. Adjoining seat backs are locked together to stabilize the overall structure in the fully deployed position. It is noted that the loveseat structure does not provide for accommodations such as canopies or tables for the comfort of the users.

The additional comfort of a shade umbrella is provided in U.S. Pat. No. 5,301,998 to Davis. This structure is constituted by a pair of foldable lounge seats connected along the respective inboard sides to a table panel positioned between the two seats. A convex depression in the top of each lounge seat panel accommodates collapsing of the hinged seat back. The lounge seats and table panel are foldable into a compact rectangular shape. Carrying straps are provided for transporting the collapsed device. An opening in the table panel accommodates an umbrella pole to provide shade, and to secure the overall device to the ground when fully deployed for use. It is noted that the support for the seats is provided by the ground rather than support structures such as that found with the previously cited examples of conventional art. Also, transportation of the seat structure requires disassembly into a plurality of pieces. Thus, the provision of the shading apparatus results in an awkward arrangement for transporting the structure.

A more elaborate shading arrangement is provided by the canopy attachment for a lawn chair disclosed in U.S. Pat. No. 5,080,432 to Connel. In this arrangement an individual canopy is provided, but for an individual chair. The canopy frame is mounted on the chair via a detachable connection to the cross rod that is arranged in the chair at the junction of the chair seat and the chair back. The canopy frame is made up of a plurality of relatively foldable parts for compact disposition when detached from the chair. In addition to the detachable of the chair, the canopy support frame has a further connection to the chair in upwardly spaced relation to the cross member, plus a roof projecting forwardly from the upper end of the support. Like the other examples of the conventional art, the use of the canopy creates an additional separate piece to be carried when the seating arrangement is transported. Also, the overall structure of the canopy is rather large and awkward to transport. Further, assembly of the canopy to the chair is also relatively complex and awkward.

A much more simplified personal canopy arrangement is found in U.S. Pat. No. 4,687,249 to Mills. The structure disclosed therein is for an adjustable canopy for a wheelchair or a beach chair. The canopy is constituted by a tubular frame which may be turned and set into any desired angular position. Also, the tubular frame of the canopy can be coupled to the tubular back frame of a chair in a frictional relationship to be slidable along the back frame of the chair so that the canopy may be set to a variety of elevations above the seat of the chair. Since the canopy is designed to be used with a separate chair, the chair and the canopy must be transported as two separate pieces. Consequently, transportation of the overall structure (chair and canopy) becomes far more problematical than with transportation of a single piece. Further, only a single chair can be accommodated by the canopy while the canopy provides no additional accommodations such as a chair stand or a foot rest that might be desired by the user.

Both a chair table and footrest are provided by the collapsible chaise lounge structure of U.S. Pat. No. 5,251,956 to Hofmeyer. The foldable table and attachment is connected to a sidebar of the collapsible chaise lounge for pivotal movement between a storage position and overlying engagement with a surface of the seat portion of the chaise lounge, and a fully deployed use position wherein the table top extends generally horizontally outward from the seat portion. A pivotal leg structure on the table top is moved from a storage position parallel to the table top to a fully deployed use position extended downwardly from the table top to the ground to achieve support. Because of this arrangement, the chaise lounge-table combination may be collapsed and stored in the same space as that required for the storage of the chaise lounge alone. However, only a single individual can be seated upon the structure and there is no accommodations for a canopy.

Thus, while the conventional art has achieved a number of aspects of a desirable multi-person seating arrangement, each of the aforementioned designs has severe limitations. Further, none of the aforementioned designs has been able to include all of the desirable features found in the many examples of the conventional art.

SUMMARY OF THE INVENTION

It is one object of the present invention to provide a double chaise lounge structure with individual canopies and an intervening table so that the entire structure is collapsible for transport as a single piece.

Another object of the present invention is to provide a collapsible, portable chaise lounge and table structure having no separate, detachable parts, and which is easily transportable.

It is a further object of the present invention to provide a double chaise lounge structure with individually adjustable shade canopies.

It is a still another object of the present invention to provide a double chaise lounge arrangement with an intervening table where the distance between the chaise lounge and the table is separately adjustable.

It is an additional object of the present invention to provide a double chaise lounge-table arrangement that is collapsible into a single, easily-transportable arrangement.

It is yet another object of the invention to provide a collapsible, portable chaise lounge configuration in which the shade canopy is adjustable in a wide variety of shapes or positions.

These and other goals and objects of the present invention are achieved by a portable, collapsible multi-chair structure having two chairs and an intervening table structure. Each of the chairs includes a backrest and a seat arranged so that the backrest can fold adjacent to the seat. The two chairs are connected to the table by first and second connectors, and third and fourth connectors are arranged on respective chairs opposite the table. Third and fourth connectors are positioned to hold the overall structure together when the chairs are folded over the table structure.

The aforementioned goals and objects are also achieved by a second embodiment which includes a method of a collapsing and transporting a chair structure as a single piece. This chair structure includes a dual chair arrangement with an intervening table. Each of the chairs has a seat and a backrest. Each of the chairs is held flexibly to the table by a connector. The method includes the steps of folding the backrest adjacent to the seat for each of the chairs to form first and second folded arrangements. The first folded arrangement is folded over the table and the second folded arrangement is folded over the first folded arrangement. The two folded arrangements are attached to each other by a pair of connectors. An extendable handle is then pulled from the table so that the entire structure can be easily lifted for carrying.

BRIEF DESCRIPTION OF THE DRAWINGS

FIG. 2A is a perspective view diagram of the bottom of the FIG. 1 structure in a partially folded position.

FIG. 2B is an enlarged, front view diagram depicting the details of the adjustable connection device between the seats and the table.

FIG. 2C is an enlarged, top perspective view diagram of the connection device.

DETAILED DESCRIPTION OF THE PREFERRED EMBODIMENTS

Figure 1:
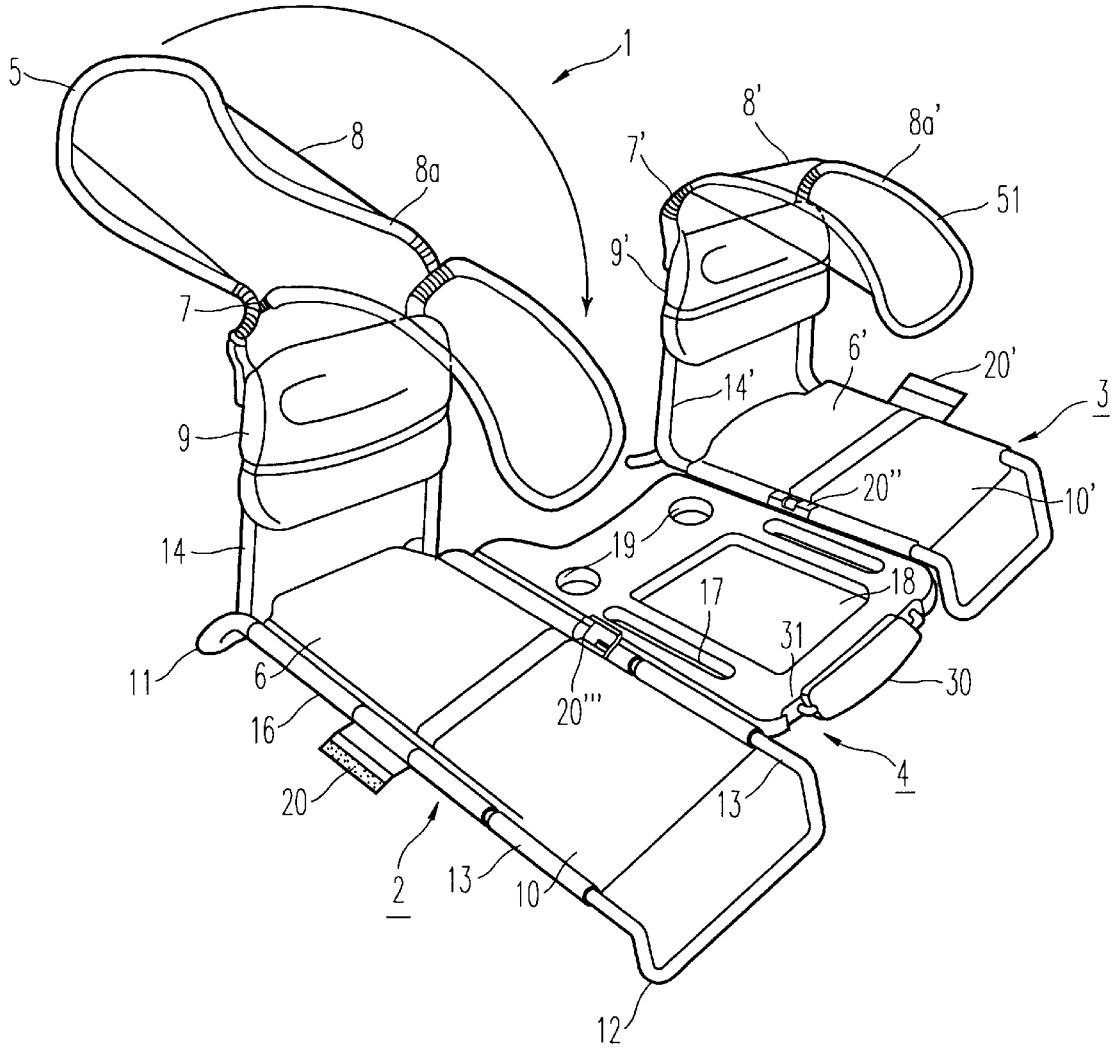
FIG. 1 is a perspective diagram depicting the double chaise lounge structure in a fully deployed arrangement.

FIG. 1 depicts the invention in the fully deployed mode so that two people can sit comfortably side-by-side with a supporting surface between them. The overall structure 1 includes two chaise lounges 2 and 3, and a table 4 located therebetween and connected thereto. Because of this arrangement both users can use the structure in comfort without crowding each other. Both users also have access to table 4. Each chaise lounge also has canopy, 5 and 5', respectively. Each chaise lounge 2 and 3 includes a seat 6 and 6', respectively, a back support or backrest support 9 and 9', respectively, and a leg rest 10 and 10', respectively. Each back support 9 and 9' is mounted on and supported by tubular supports 14 and 14' which form a back rest support. The head and foot of each chaise lounge is supported on the ground by U-shaped tubular ground support pieces 11 and 12. Support pieces 11 and 12 are connected together by outer and inner tubular supports 13 and 16 on each side of seat 6 and leg rest 10.

Each canopy 5 and 5', respectively, includes a canopy cover 8 and 8' which can be made of any type of material desired by the user. For example, canopy cover 8 and 8' can be opaque, translucent or transparent, and can be made of plastic or a variety of fabrics. Each canopy cover 8 and 8' is depicted as being mounted on a canopy frame 8*a* and 8*a'*, respectively. Also, canopy cover 8 and 8' can extend downward in front of its respective canopy frame to provide added protection on either side of the frame.

Canopies 5 and 5' are respectively connected to backrest supports 14 and 14' by individual spring connectors 7 and 7'. Each canopy frame 8*a* and 8*a'* is rigidly mounted to a spring connector 7 and 7', which in turn is rigidly connected to backrest pieces 14 and 14' respectively. In the alternative, canopy frames 8*a* and 8*a'* can be connected to spring connectors 7 and 7' by way of adjustable clamps (not shown). By loosening the clamps, the tubular canopy frames 8*a* and 8*a'* can retract into the hollow tubular backrest supports 14 and 14' respectively until only the U-shaped portions of the canopy 5 and 5' extend above the backrest supports 14 and 14'. Of course, the canopy cover 8, 8' would have to be removed for this to be done. Because a wide variety of possible canopy covers have been suggested above for use in this invention, each cover type would be easily removable using techniques well known in this art that are particular to the canopy type.

Each canopy frame 8*a* or 8*a'* can be rotated from the frame of the backrest to the rear of the backrest. Thus, the spring connectors 7 and 7' permit the canopy frame 8*a* and 8*a'* to be adjusted in any manner desired by the user. Further, when not in use, the canopy frame 8*a* and 8*a'* can be bent back behind the backrest. It is also possible that the canopy frame 8*a* or 8*a'* with the proper canopy cover 8 or 8' can be used as a storage or a holding compartment for items carried by the user of the chaise lounge.

Figure 3:
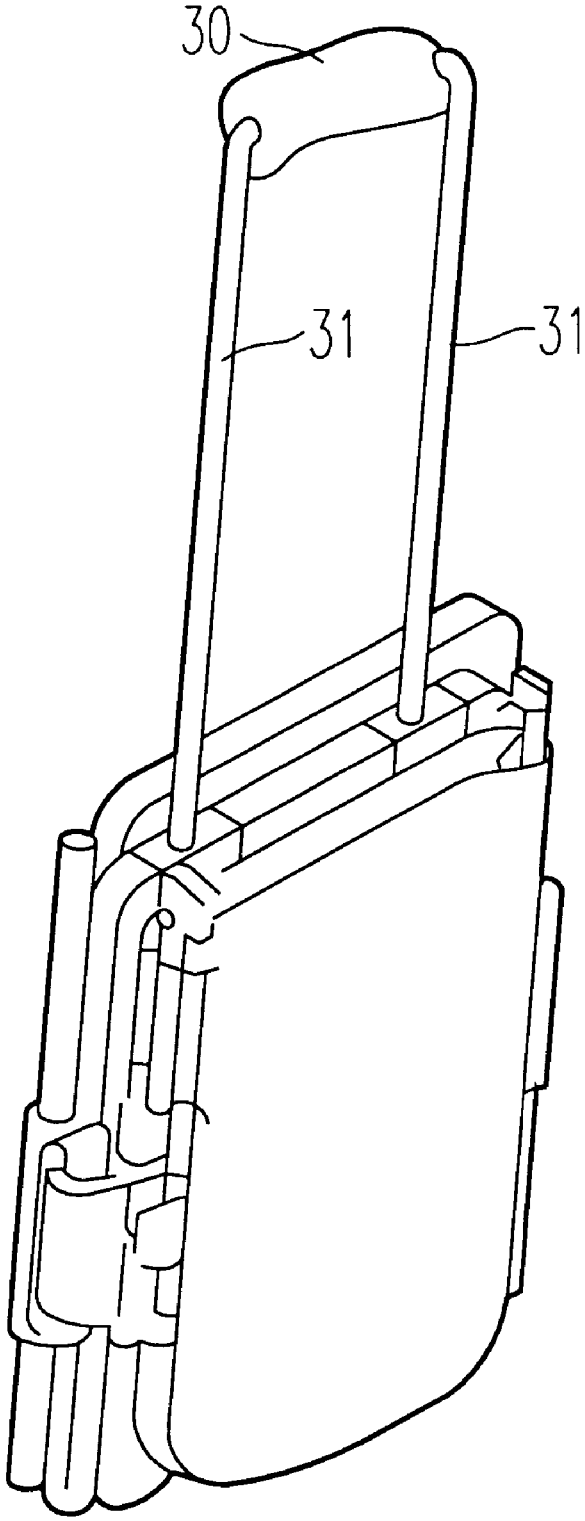
FIG. 3 is a perspective diagram depicting the double chaise lounge structure in a fully collapsed or folded arrangement.

The table 4, which is accessible by the occupants of both chaise lounges 2 and 3, is connected to both chaise lounges by adjustable connectors 20", 20'". These connectors are illustrated in greater detail in FIGS. 2A, 2B and 2C, and are discussed in greater detail herein below. Table 4 contains a retractable handle 30 connected to the table by a pair of support pieces 31 constituted by tubular members. FIG. 1 depicts handle 30 in the retracted position while FIGS. 2A and 3 depict handle 30 in the extended position for easy transport of the chair structure 1.

Table 4 includes an indentation 18, which is useful for holding objects that have the tendency to roll from the table such as plates, trays or baskets. The table also includes cup holders 19 for the convenience of both users. For handling and manipulation of the chair structure 1 slots 17 are included on either side of the table. Slots 17 can be particularly helpful during the process of deploying or folding structure 1 when the handle 30 is in the retracted position and can be used as holders, such as for books, when the table has been deployed.

Adjustable connectors 20" and 20'" permit chaise lounges 2 and 3 to be flexibly connected to the table 4 in a stable fashion that, together with the head and foot ground support pieces 11 and 12 of each chaise lounge 2 and 3 form a stable structure that easily handles the movement of one or two occupants. Duplicates of the adjustable connectors are arranged on the outer support tubes 16 of each of the chaise lounges 2, 3 respectively, and are depicted as 20 and 20' in FIG. 1. Similarly adjustable connectors 20" and 20'" are arranged on runner support tubes 13. The use of these adjustable connectors are explained below.

The details and application of all of the adjustable connectors 20, 20', 20", 20'" which are identical, are depicted in FIGS. 2A, 2B, and 2C and will be discussed only with respect to connector 20. Adjustable connector 20, as depicted in FIGS. 2B and 2C, includes two clasping portions 21 and 22 and an adjustable extending portion 25 between the two clasping portions. VELCRO® (synthetic materials which adhere when pressed together) fasteners 23 are used to hold the clasping portion to itself when it is wrapped around a piece of the chaise lounge or table. The VELCRO® portion 23 can also be used to hold clasping portion to the fabric of either the chaise lounges, or to another adjustable connector 20. Adjustable extending portion 25 has the capability of extending several inches to allow adjustment between the chaise lounges and the table. The use of the extension portion 25 also facilitates folding of the overall structure 1 into a compact arrangement as shown in FIG. 3. The extension of one of the adjustable connectors 20 in FIG. 2A permits one of the chaise lounges (in folded configuration) to be folded over table 4 and in turn to have the second chaise lounge 3 fold over the first chaise lounge. The whole arrangement is held together with connectors 20 and 20' being held to each other by way of the VELCRO® portions (23 in FIG. 2B).

When using the component set the clasping portions 21 and 22 should be completely closed together. They can be secured by lifting up the small piece 24 on clasping portion 22 side (VELCRO®) and fitting small extended, pen like protrusion into the small holes on the clasping portion 21 side, and snapping shut. Thus, locking each set into a secured position preventing shifting or movement, while using.

To obtain the configuration in FIG. 2A, each of the chaise lounges 2 and 3 is compacted by folding and retracting the various portions constituting them. First, canopy frame 8*a* is folded either forward in front of the back support 9, or in the alternative behind back support 9. As previously discussed, frame 8*a* can also be retracted by telescoping it into hollow tubular supports 14, which constitutes the backrest support. Back support 9 itself can be tilted forward over seat 6, or can be rotated (along with ground support 11) so that both are positioned underneath the seat. Thus, folding of the back support 9 against seat 6 can be accomplished by rotation in either direction. The particular direction selected is determined by the manner in which the canopy frame 8*a* is compacted with respect to back support 9.

Leg rest 10 can be folded to seat 6 by telescoping tubular support 13 into tubular support 16. The extent of such retraction is somewhat limited by the presence of leg rest 10 interfering with seat 6. However, additional compaction can be obtained by rotating tubular supports 13 of leg rest 10 with respect to the tubular support 16 supporting the seat 6. This can be done by hinges (not shown) placed between the two sets of tubular supports (16 and 13, respectively). Such rotation could be of the seat portion and would bring seat 6 either over leg rest 10 or underneath it, depending upon the position of the folded backrest 9. However, leg rest 10 could also be rotated depending upon the exact location of the adjustable connector.

Any of the variations previously described can be carried out to reach the arrangement depicted in FIG. 3. This arrangement provides a single piece arranged and balanced for easy carrying with the handle 30 extending by way of support tubes 31 from table 4 for easy transport of the entire structure.

All of the aforementioned variations and permutations are part of the flexibility permitted by the preferred embodiment of the present invention. However, the present invention should not be considered limited thereby. Rather, the present invention should be considered to include any variations, permutations, modifications and appropriate arrangements falling within the scope of the following claims.

We claim:

1. A portable, collapsible, multi-chair structure comprising:

(a) two chairs, each having a backrest and a seat;

(b) a table structure mounted between said two chairs, and connected thereto by a first adjustable connector and a second adjustable connector, respectively, wherein said table structure further comprises indentations configured to hold beverage cups and a retractable carrying handle having dual tubular supports arranged to slide into said table structure;

(c) a third adjustable connector arranged on a side of said first chair opposite said table structure; and (d) a fourth adjustable connector arranged on a side of said second chair opposite said table structure, at least one of said third and fourth connectors being positioned to hold said chairs to said table when said two chairs are folded with respective backrests adjacent to respective seats and each chair is folded over said table structure.

2. A portable, collapsible, multi-chair structure comprising:

(a) two chairs, each having a backrest and a seat;

(b) a table structure mounted between said two chairs, and connected thereto by a first adjustable connector and a second adjustable connector, respectively, wherein at least one of said first and second connectors comprises two clasps and an extendable portion arranged between said clasps to vary the distance therebetween;

(c) a third adjustable connector arranged on a side of said first chair opposite said table structure; and (d) a fourth adjustable connector arranged on a side of said second chair opposite said table structure, at least one of said third and fourth connectors being positioned to hold said chairs to said table when said two chairs are folded with respective backrests adjacent to respective seats and each chair is folded over said table structure.

3. The structure of claim 2, wherein each of said chairs further comprises means for pivotally folding said backrest adjacent to said seat.

4. The structure of claim 3, wherein each of said chairs further comprises a leg rest in a chaise lounge configuration.

5. The structure of claim 4, wherein said seat is supported by dual tubular seat supports and said leg rests are supported by corresponding tubular leg rest supports in respective collinear arrangement with said dual tubular seat supports.

6. The structure of claim 5, wherein each said chair comprises a pair of U-shaped ground supports, a first one of said U-shaped ground supports being located beneath said backrest at a first end of said chair while a second one of said U shaped ground supports being located at a second end of said chair opposite said backrest.

7. The structure of claim 5, wherein said dual tubular seat supports and said dual tubular leg rest supports are arranged to telescope and retract with respect to each other.

8. A portable, collapsible, multi-chair structure comprising:

(a) two chairs, each having a backrest and a seat, wherein each chair further comprises an adjustable canopy having a frame and a cover;

(b) a table structure mounted between said two chairs, and connected thereto by a first adjustable connector and a second adjustable connector, respectively;

(c) a third adjustable connector arranged on a side of said first chair opposite said table structure; and (d) a fourth adjustable connector arranged on a side of said second chair opposite said table structure, at least one of said third and fourth connectors being positioned to hold said chairs to said table when said two chairs are folded with respective backrests adjacent to respective seats and each chair is folded over said table structure.

9. The structure of claim 8, wherein each said canopy is connected to each said chair by means of spring connectors arranged to rotate said canopy from a front surface of said backrest to a rear surface of said backrest.

10. The structure of claim 9, wherein said spring connectors are connected to upright dual tubular backrest supports extending above said backrest.

11. A method of collapsing and transporting as a single piece a structure comprising a dual chair arrangement with intervening table, where each said chair has a backrest and seat, said table and chairs are flexibly held together with connectors and said table includes a retractable carrying handle, said method comprising the steps of:

(a) folding said backrest of each chair adjacent to said seat of each chair to form first and second folded arrangements;

(b) folding said first folded arrangement over said table;

(c) folding said second folded arrangement over said first folded arrangement; and, (d) extending said carrying handle to lift said structure.

12. The method of claim 11, wherein step (c) comprises the substep of using at least two of said connectors to hold said first folded arrangement to said second arrangement and said table.

13. The method of claim 11, wherein each said chair further includes a canopy, and step (a) includes the substep of folding said canopy of each chair to said backrest of each respective chair.

* * * * *